US008282100B2

(12) United States Patent
Kido

(10) Patent No.: US 8,282,100 B2
(45) Date of Patent: Oct. 9, 2012

(54) ROULETTE GAME DEVICE

(75) Inventor: Katsuhiro Kido, Koto-ku (JP)

(73) Assignees: Universal Entertainment Corporation, Tokyo (JP); Aruze Gaming America, Inc., Las Vegas, NV (US)

( * ) Notice: Subject to any disclaimer, the term of this patent is extended or adjusted under 35 U.S.C. 154(b) by 228 days.

(21) Appl. No.: 12/781,183

(22) Filed: May 17, 2010

(65) Prior Publication Data

US 2010/0301556 A1 Dec. 2, 2010

(30) Foreign Application Priority Data

May 29, 2009 (JP) ..... 2009-130496

(51) Int. Cl.
*A63F 5/02* (2006.01)

(52) U.S. Cl. ..... 273/142 E

(58) Field of Classification Search ..... 273/142 E, 273/142 F, 142 G, 142 H, 142 HA, 142 J, 273/142 JA, 142 JB, 142 JC, 142 JD
See application file for complete search history.

(56) References Cited

U.S. PATENT DOCUMENTS 4,601,470 A * 7/1986 Kadota et al. ..... 273/142 E
4,869,505 A * 9/1989 Manabe ..... 463/22
6,042,114 A * 3/2000 Phillip ..... 273/142 R
2010/0124966 A1 5/2010 Kido

OTHER PUBLICATIONS

U.S. Appl. No. 12/781,343, filed May 17, 2010, Kido.

* cited by examiner

*Primary Examiner* — Benjamin Layno
(74) *Attorney, Agent, or Firm* — Lexyoume IP Meister, PLLC.

(57) ABSTRACT

A roulette game device is provided that allows a ball revolving on the roulette wheel to be easily observed from players and spectators around the roulette game device, and can facilitate betting for a player. An outer circumferential wall 29 of an inclined face 28, which is formed so as to extend from pockets 23 of a roulette device in an outer circumferential direction, includes a guide portion 291 that is provided at an upper portion thereof so as to protrude towards inside of the inclined face 28, in which a length that the guide portion 291 protrudes towards the inside of the inclined face 28 is shorter than a length of a radius r of the ball 11, which is thrown onto the roulette wheel.

5 Claims, 12 Drawing Sheets

ROULETTE GAME DEVICE

CROSS REFERENCE TO RELATED APPLICATIONS

This application is based on and claims the benefit of priority from Japanese Patent Application No. 2009-130496, filed on May 29, 2009, the content of which is incorporated herein by reference.

BACKGROUND OF THE INVENTION

1. Field of the Invention

The present invention relates to a roulette game device. In particular, it relates to a roulette game device provided with a roulette wheel on which a ball revolving on the roulette wheel is easily viewed from game players and spectators around the roulette game device.

2. Related Art

The roulette game device is a game device in which a player buys or borrows a plurality of medals from a medal lending machine, a roulette game starts by inserting these medals into the roulette game device, and a predetermined number of medals are paid out if the player wins in a game.

The roulette game device performs a roulette game. More specifically, when a player selects a mark (number) located on the roulette wheel, the roulette wheels rotates, and a ball is thrown and revolves on the roulette wheel. At first, due to centrifugal force, the ball continues to revolve at a predetermined speed while pressing against an upper end portion of the outer circumferential wall, which is provided to protrude to inside from an upper end of the outer circumferential wall of the roulette wheel and made in a groove-shaped cross-section; however, when the centrifugal force weakens, the ball falls and is held in any of the pockets established at the lower side thereof due to gravity. These pockets correspond respectively to marks (numbers) disposed on the roulette wheel, and the mark (number) selected by a player is compared with a mark corresponding to the pocket in which the ball has fallen. In a case where a mark (number) selected by the player and the mark (number) of the pocket in which the ball has fallen match, it is determined that the player has won, and then medals are paid out to the player at a predetermined rate.

A player places a bet by predicting the mark corresponding to the pocket into which the ball will fall; however, this bet can be made even if the ball has been thrown onto the roulette wheel, and has started revolving. As a result, the player can place a bet by reading the trajectory on which the ball is rolling (e.g., see U.S. Pat. No. 4,869,505).

When a ball is thrown onto a roulette wheel, it is thrown along an outer circumferential wall of the roulette wheel with a certain degree of momentum, so that the ball revolves on the roulette wheel for a long time. When this is done, the ball thus thrown revolves along the outer circumferential wall for a while, due to the force applied when throwing and centrifugal force. Therefore, in the outer circumferential wall of the roulette wheel, it has been common for a large continuous flange to be provided at an upper end portion in an endless manner so as to cover a portion of an outer circumference of the roulette wheel toward inside thereof, so that an accommodating space of a toroidal shape made in a groove-shaped cross-section is formed entirely, while a distance between a lower side end portion and an upper side end portion of the outer circumferential wall is several times longer than a diameter of a ball.

In such a case, a case arises where the ball revolving on the roulette wheel is held in the accommodating space of a toroidal shape made in a groove-shaped cross-section, and for players surrounding the roulette game device, the ball revolving on a near side becomes unviewable. With such a problem, there becomes an important problem for a roulette game device in that a bet is made by predicting the trajectory on which the ball revolves, and relating this to the color and number of the pocket in which the ball will ultimately fall.

The present invention has an object of providing a roulette game device that allows the ball revolving on the roulette wheel to be easily viewed by players and spectators surrounding the roulette game device, and can facilitate betting for players.

SUMMARY OF THE INVENTION

According to a first aspect of the present invention, a roulette game device with a roulette wheel includes: a roulette wheel having a plurality of pockets which is created so as to be continuous in a circumferential direction and in which a ball is held; an inclined face formed so as to extend from the plurality of pockets to an outer circumferential direction; a plurality of marks located on the inclined face, and created to correspond to each of the plurality of pockets; and an outer circumferential wall that is provided in an endless manner along an outer circumferential edge of the inclined face, in which the outer circumferential wall has a guide portion of a loop shape that is provided at an upper portion of the outer circumferential wall, and provided so as to protrude towards inside of the inclined portion, and a length that the guide portion protrudes towards the inside is shorter than a length of a radius of the ball.

According to the first aspect of the invention, the outer circumferential wall of the inclined face, which is formed so as to extend from the pockets of the roulette device to the outer circumferential direction, has a guide portion provided so as to protrude towards inside of the inclined face at an upper portion thereto, and the length that the guide portion protrudes towards inside the inclined face is shorter than a length of a radius of the ball thrown onto the roulette wheel. In this way, even when the ball is at a near side to the player, the ball can be viewed. Accordingly, since from when the ball is thrown onto the roulette wheel and the ball starts revolving along the outer circumferential wall, the player can view the entire roulette wheel, it is easy for a player to predict the revolving trajectory of the ball according to the revolving speed of to ball and the revolution speed of the roulette wheel, and thus easily predict the mark of the pocket in which the ball will fall.

According to a second aspect of the present invention, the roulette game device as described in the first aspect further includes: a table-frame portion that is provided outside of the outer circumferential wall; and a cover portion that is disposed on an upper face side of the table-frame portion, and is disposed so as to follow an outer circumference of the outer circumferential wall, and so as to cover at least a portion of a top surface of the table-frame portion, in which an inner circumferential edge of the cover portion is disposed at a position that is spaced a predetermined distance from the outer circumferential wall.

According to the second aspect of the present invention, in addition to the roulette game device as described in the first aspect, a table-frame portion provided along the outer circumferential wall is disposed outside of the outer circumferential wall, and a cover portion is arranged on an upper face of the table-frame portion. The cover portion is formed so as to follow the outer circumference of the outer circumferential wall, and an inner circumferential edge thereof is arrange at a position spaced a predetermined distance from the outer circumferential wall. In this way, the cover portion does not protrude from the outer circumferential wall toward the inside. Accordingly, the line of sight of players and spectators around the roulette device is not obstructed, and thus the state of the ball revolving can be viewed.

According to a third aspect, in the roulette game device as describes in the second aspect, the guide portion, the cover portion, and at least a portion of the outer circumferential wall are transparent.

According to the third aspect of the present invention, in addition to the roulette game device as described in the second aspect, the guide portion, the cover portion and at least a portion of the outer circumferential wall are transparent. In this way, the line of sight of the players and spectators around the roulette device is not obstructed, and thus the state of a ball revolving can be viewed.

A roulette game device is provided that allows a ball revolving on the roulette wheel to be easily observed from players and spectators around the roulette game device, and can facilitate betting for a player.

DETAILED DESCRIPTION OF THE INVENTION

Figure 1:
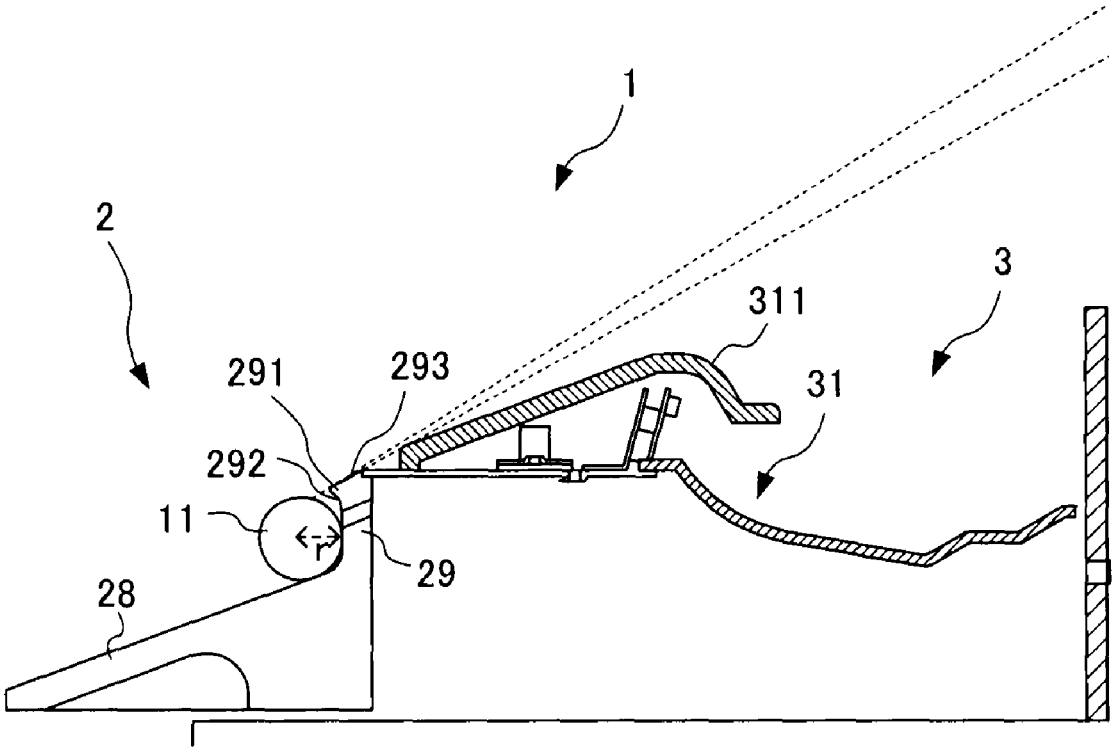
FIG. 1 is an enlarged cross-sectional view of an outer circumferential wall portion of a roulette game machine, which is an embodiment of the present invention.

Embodiments of the present invention are explained below with reference to the drawings. Although a roulette game machine 1, which is the roulette game device of the present invention, is explained below, in summary, in the roulette game machine 1 as the roulette game device, as shown in FIG. 1, an outer circumferential wall 29 of an inclined face 28 on which a ball 11 revolves in the roulette device 2 includes a guide portion 291 that protrudes inwards at an upper portion thereof. In addition, a length that this guide portion 291 protrudes towards an inward side is formed so as to be smaller than a radius r of the ball 11. Accordingly, for players located around the roulette game machine 1, even when the ball is at a near side, it is possible to easily view the ball 11.

The roulette game machine 1 is explained with reference to FIG. 2. In the roulette game machine 1, a player predicts a number and the like that will be determined by the roulette device, and bets game media such as medals possessed on the number and the like thus predicted. Furthermore, it is a roulette game machine that allows a payout of a predetermined number of medals to be received by a player, when the number and the like thus bet wins.

Figure 2:
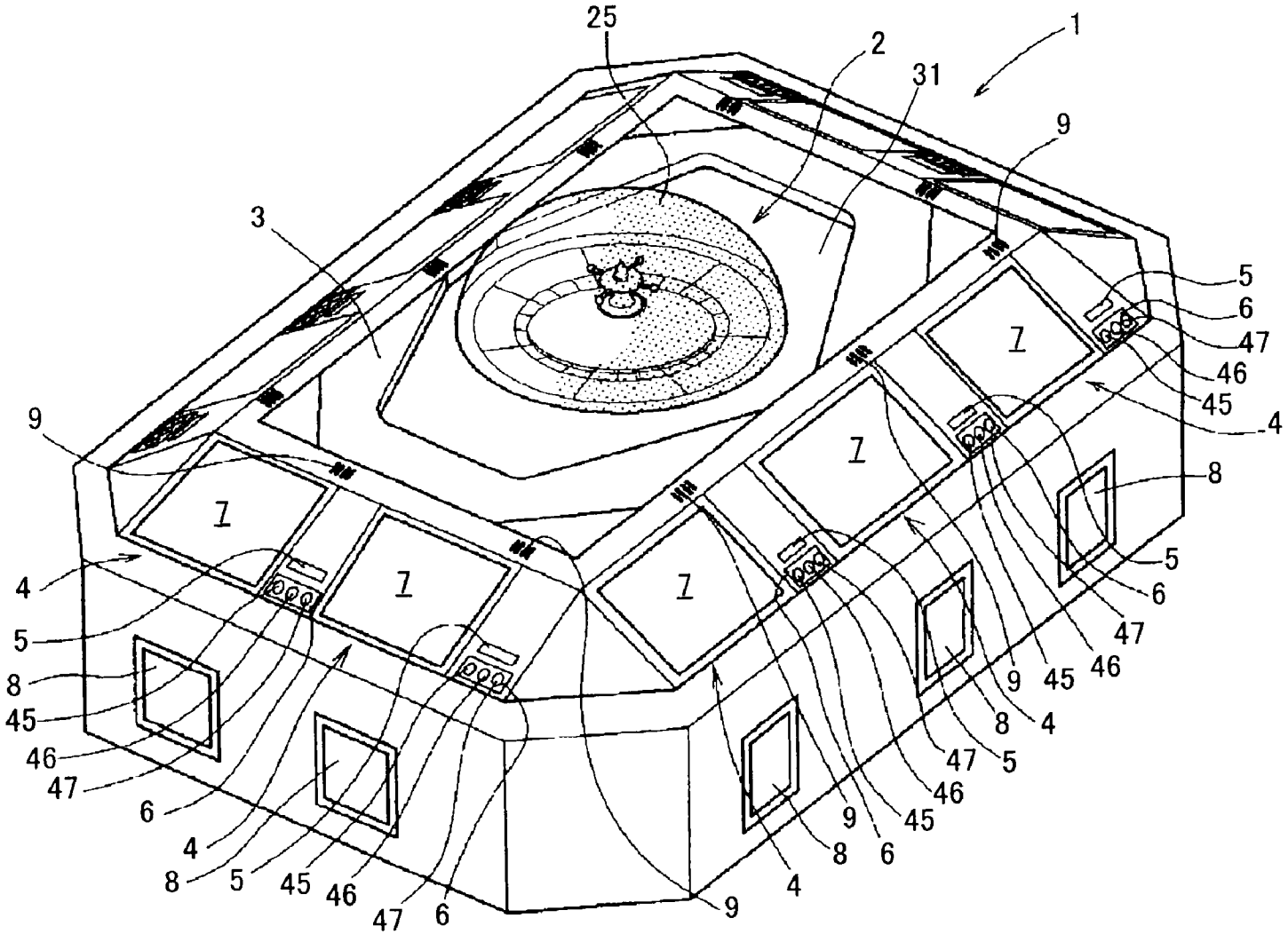
FIG. 2 is an exterior perspective view showing a schematic configuration of the roulette game machine according to the embodiment of the present invention.

FIG. 2 is an external perspective view showing a schematic configuration of the roulette game machine 1. The roulette game machine 1 is basically configured with a housing 3 that is a main portion, a roulette device 2 provided substantially at the center on an upper face of the housing 3, and a plurality of satellites 4 (e.g., 10) arranged so as to surround the roulette device 2 around the roulette device 2.

The roulette device 2 is arranged substantially at the center on an upper face of the housing 3, and is arranged so as to be fitted into a hole formed in a table-frame portion 31, which is a substantially central portion of the housing 3, and is fixed thereto. In addition, at the upper face of the roulette device 2, a cover member 25 is provided that is formed by a transparent member so as to cover an entire upper face of the roulette device 2.

Herein, the satellite 4 is a game region at least having a medal insertion opening 5 in which money or game media such as medals using in gaming are inserted, a control portion 6 composed of a plurality of control buttons and the like to which predetermined instructions are input by a player, and an image display device 7 on which images relating to a game are displayed. Consequently, it is possible for a player to cause a game that is playing out to be advanced by operating the control portion 6 or the like, while looking at an image displayed on the image display device 7.

In addition, a medal payout opening 8 is respectively provided on sides of the housing 3 on which each satellite 4 is arranged. Furthermore, a speaker 9 that projects music, sound effects and the like, is provided at the upper right of the image display device 7 of each satellite 4.

Then, a medal sensor (not illustrated) is provided inside of the medal insertion opening 5, and this performs identification of game media such as medal inserted by way of the medal insertion opening 5, while counting the medals thus inserted. In addition, a hopper (not illustrated) is provided inside of the medal payout opening 8, and a predetermined number of medals are paid out from the medal payout opening 8.

Figure 3:
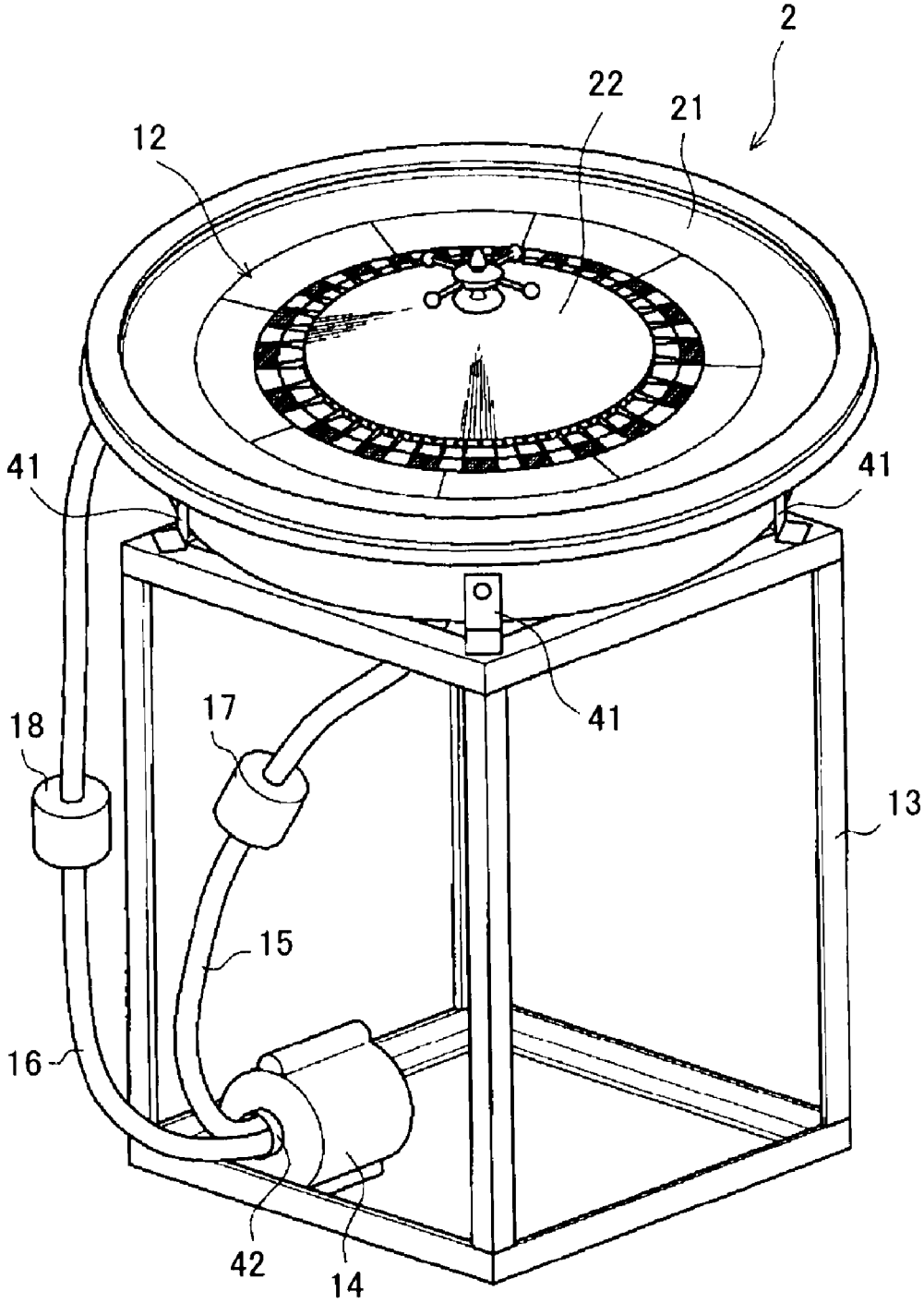
FIG. 3 is a perspective view showing a roulette device according to the embodiment of the present invention.
Figure 4:
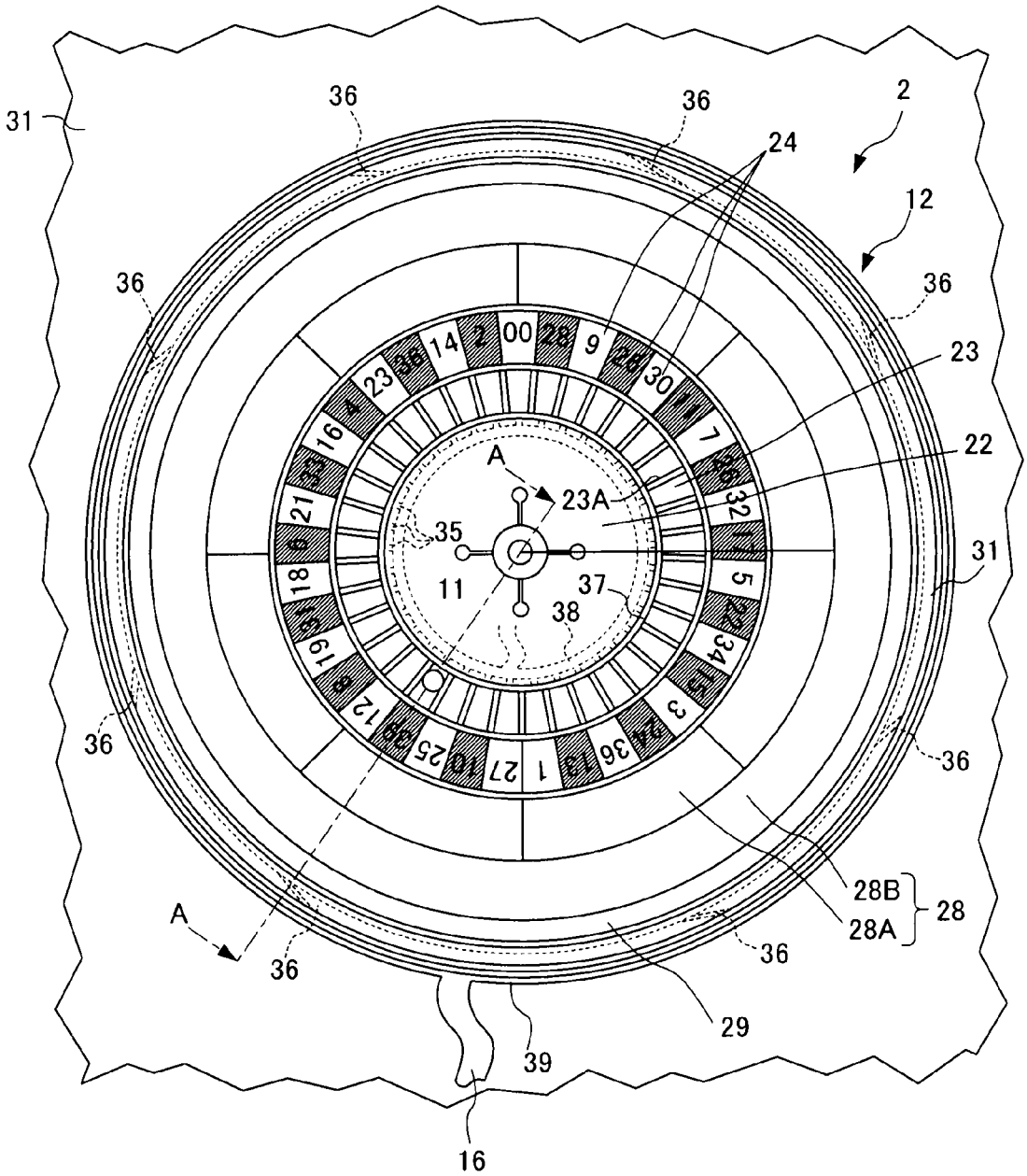
FIG. 4 is a plan view showing a roulette device according to the embodiment of the present invention.
Figure 5:
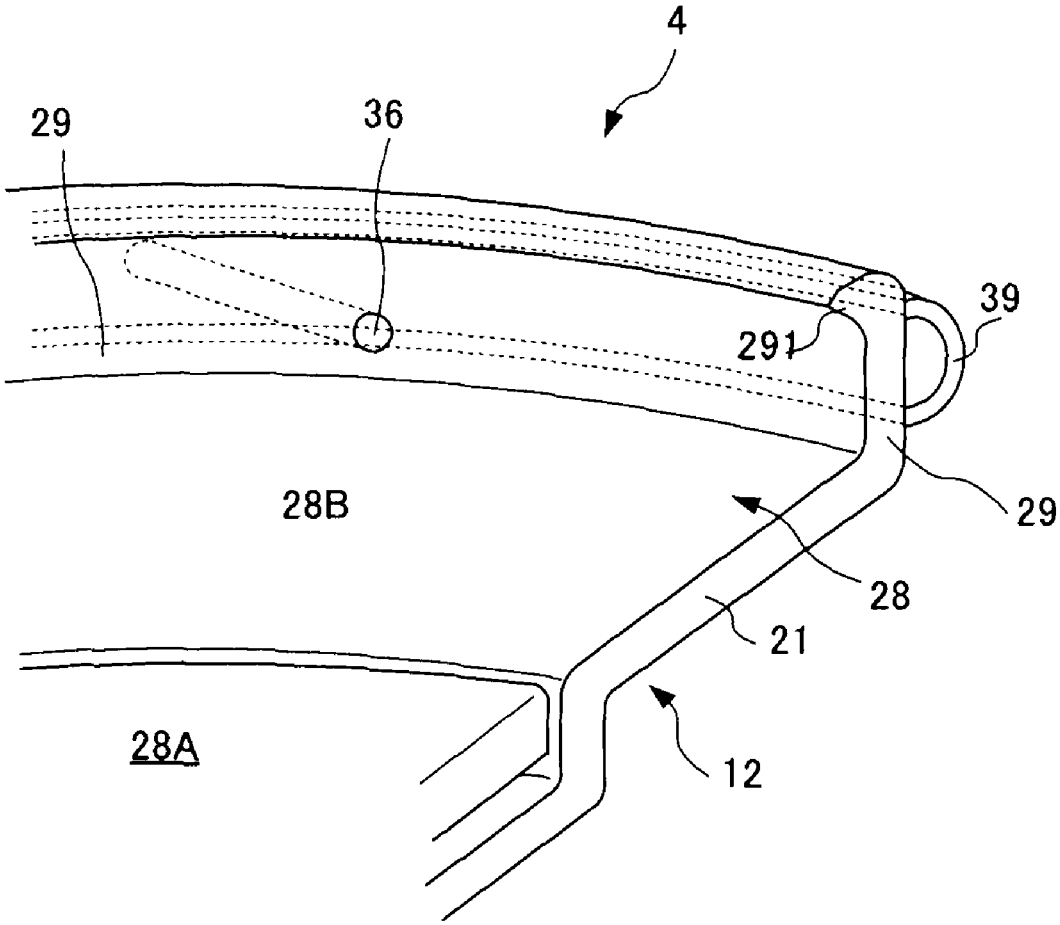
FIG. 5 is a perspective view showing an enlargement of a vicinity of the outer circumferential wall of the roulette device according to the embodiment of the present invention.
Figure 6:
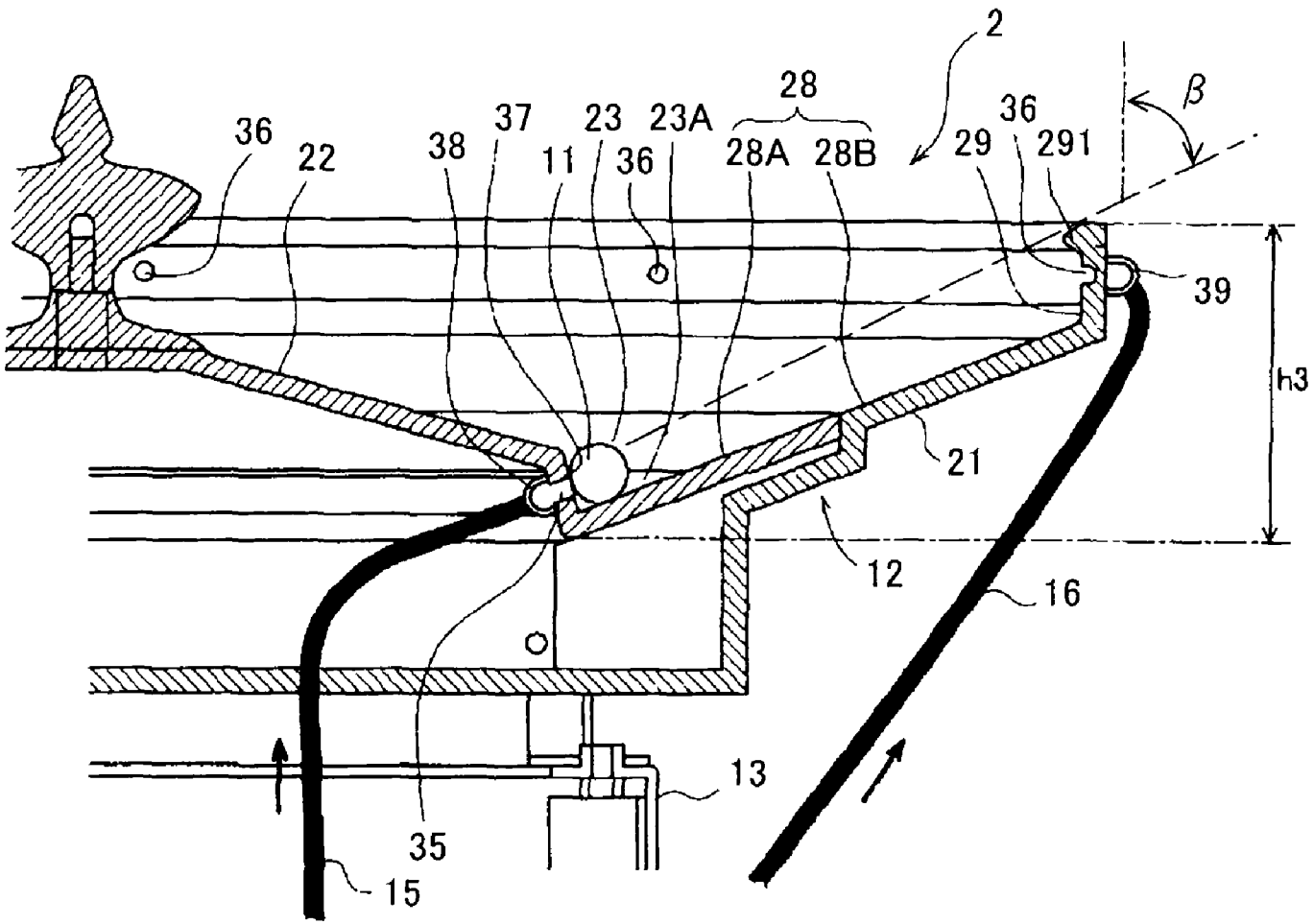
FIG. 6 is a cross-sectional view in which the roulette device is cut along the line A-A of FIG. 4.
Figure 7:
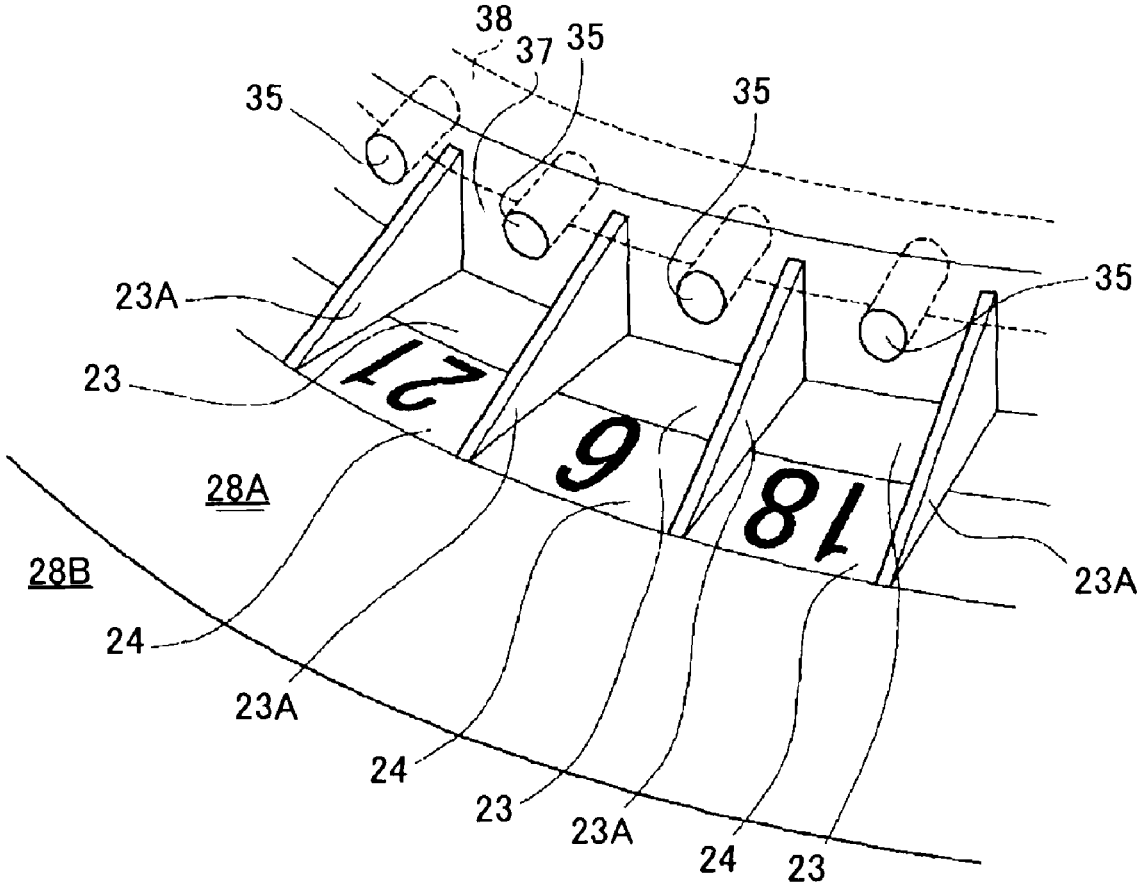
FIG. 7 is a perspective view showing an enlargement of a vicinity of the pockets of the roulette device according to the embodiment of the present invention.
Figure 8:
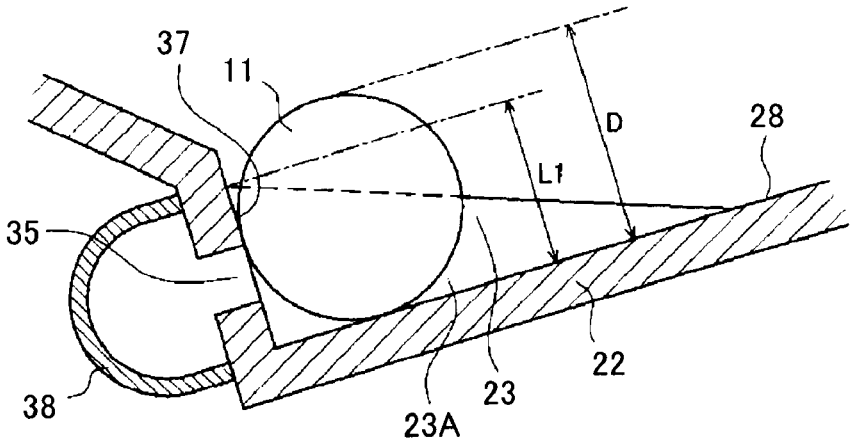
FIG. 8 is a schematic diagram showing a pocket according to the embodiment of the present invention.
Figure 9:
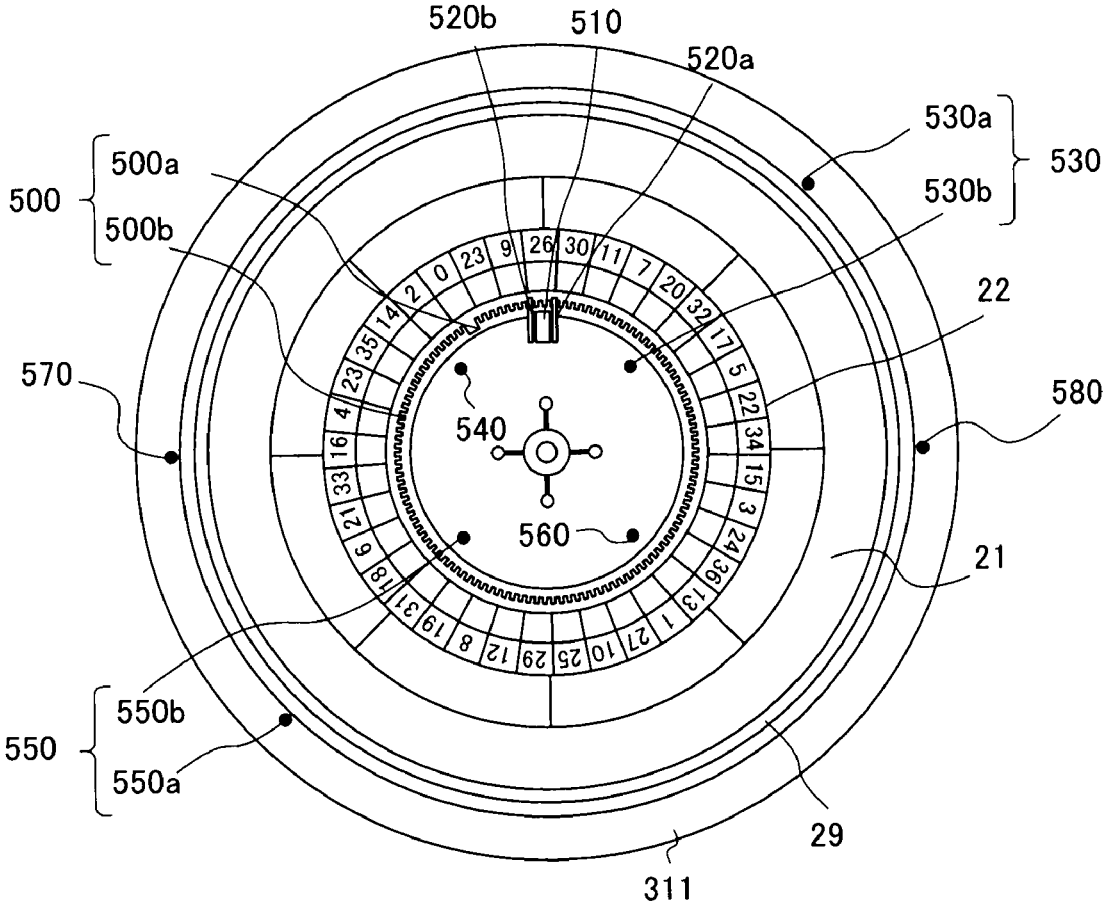
FIG. 9 is a plan view showing a configuration of a lower portion of a wheel and an arrangement of various sensors according to the embodiment of the present invention.

Next, a configuration of the roulette device 2 is explained with FIGS. 3 to 9. FIG. 3 is a perspective view showing the roulette device 2, FIG. 4 is a plan view showing the roulette device 2, and FIG. 5 is a perspective view showing an enlargement of a vicinity of the outer circumferential wall 29 of the roulette device 2. FIG. 6 is a cross-sectional view in which the roulette device 2 is cut along the line A-A of FIG. 4. FIG. 7 is a perspective view showing an enlargement of a vicinity of the pockets of the roulette device 2. FIG. 8 is a schematic diagram showing a pocket 23. FIG. 9 is a plan view showing a configuration of a lower portion of a wheel 22 and an arrangement of various sensors.

As shown in FIGS. 3 and 4, the roulette device 2 is mainly configured with a roulette wheel 12 having a rolling area in which the ball 11 rolls during a game, a support rack 13 that supports the roulette wheel 12 inside the roulette game machine 1, a compressor 14 that takes in and compresses ambient air to a predetermined pressure, air tubes 15 and 16 that transfer air compressed by the compressor 14, a first open-close valve 17 and a second open-close valve 18 that are provided in middle points of the air tube 15 and 16, respectively, and adjust the air pressure.

In addition, the roulette wheel 12 is mainly provided with a frame body 21 that is fixed at the support rack 13 and a wheel 22 that is held and supported inside the frame body 21 to be rotatable. Then, the wheel 22 has a number of pockets 23 (e.g., 37 pockets) formed in the shape of recesses on the upper face of the wheel. The pockets 23 are divided by a partitioning wall 23A of a substantially triangular shape, and furthermore, marks 24 in which each number from "0" and "1" to "36" is respectively displayed as a graphic figure are formed at the outer side of the respective pockets 23 on the upper face of the wheel 22. Then, over a period from immediately after the ball 11 begins to roll until a predetermined time period elapses after the ball 11 has fallen into a pocket 23, the wheel 22 is caused to rotate in a predetermined direction with respect to the frame body 21 (e.g., $2\pi$ (rad/s) to $0.2\pi$ (rad/s)) by a drive motor (not illustrated) provided inside the roulette device 2.

In addition, in a case of being disposed at the roulette game device 1, the entire upper area above the roulette wheel 12 is covered with a transparent acrylic cover member 25 formed in a hemispherical shape (see FIG. 2). Thus, it is possible to maintain the ball 11, which is revolving on the roulette wheel 12 in a game, so that it does not jump out to the outside of the roulette wheel 12. In addition, foreign material is prevented from intruding, thereby making it so that fraudulence cannot be done.

Here, a rolling area where the ball 11 actually rolls on the roulette wheel 12 is composed of a single inclined face 28 that is formed so as to extend from the pockets 23 towards an outer circumferential side. This inclined face 28 is composed of a single inclined face 28 having a predetermined angle (e.g., 15°) formed by a first inclined face 28A that is formed at an outer circumferential edge side of the frame body 21 and a second inclined face 28B that is formed at an inner circumferential edge side of the wheel 22. The inclined face 28 is inclined upward along the direction from the center to the circumference of the roulette wheel 12, and the outer circumferential wall 29 is provided in an endless fashion so as to follow the outer circumferential edge of the inclined face 28. The outer circumferential wall 29 guides the ball 11 against centrifugal force of the ball 11 rolling on the roulette wheel 12 and is a member the causes the ball 11 to roll so as to follow a circular track. The ball 11 thrown onto the roulette wheel 12, upon being thrown, rolls so as to follow the circular track along the outer circumferential wall 29. This outer circumferential wall 29 is formed so as to be continuous and rise from the outer circumferential end of the second inclined face 28B, as shown in FIG. 5.

As shown in FIG. 1, the outer circumferential wall 29 includes the guide portion 291, which is provided at an upper portion of the outer circumferential wall 29, and provided in a loop so as to protrude towards the inner circumference of the inclined face 28. The guide portion 291 is a member that is formed so as to protrude towards the inner circumference of the inclined face 28, and when the ball 11 having been thrown revolves along the outer circumferential wall 29 in a state of contacting the outer circumferential wall 29, biases the ball 11 so that it does not jump out to outside the roulette device 2.

An inclined portion 292, which is a lower face side of the guide portion 291, is formed so as to gradually protrude from the lower side of the outer circumferential wall 29 towards the inner circumference of the inclined face 28 gradually up to an upper side, in the present embodiment.

The inclined portion 292 of the guide portion 291 is preferably a shape that follows the circumference of the ball 11, when the ball 11 contacts the outer circumferential wall 29. In addition, a length that the guide portion 291 protrudes in an inner circumferential direction of the roulette wheel 12 is preferably shorter than the radius of the ball 11. As a result, even in a case where the ball 11 is contacting the outer circumferential wall 29, a portion that the guide portion 291 covers is only enough to come up to the radius of the ball 11. A viewing angle $\beta$ of the roulette device 2 for confirming the ball 11 can be made wide (see FIG. 6).

In addition, the upper face side of the guide portion 291 has an incline portion 293 the inclines from the upper side towards the lower side of the outer circumferential wall 29 at the inner circumferential side thereof. Thus, the incline portion 293 of the upper face side of the guide portion 291 is formed so as to fall downward at a predetermined angle from the leading edge of the outer circumferential wall 29, and is continuous with the inclined portion 292 of the lower face side of the guide portion 291. Therefore, the guide portion 291 is formed to protrude so as to make a triangular cross-section. As a result, by declining at a downward angle, the area over which the roulette wheel 12 is viewable can be made wider than a case in which the guide portion 291 is provided to be horizontal.

In addition, the roulette device 2 is arranged at substantially the center on an upper face side of the housing 3 of the roulette game machine 1, as shown in FIG. 1. A table-frame portion 31 for fixing the roulette device 2 is provided on an upper face side of the housing 3, and the roulette device 2 is recessed in the table-frame portion 31 and fixed to the housing 3.

The table-frame portion 31 is positioned at an outer side of the outer circumferential wall 29; however, a cover portion 311 is arranged on an upper face of this table-frame portion 31. The cover portion 311 is arranged so as to cover at least a portion of the table-frame portion 31, and in the present embodiment, is arranged so as to form a circle along the outer circumferential wall 29 and border a periphery of the outer circumferential wall 29. The cover portion 311 is formed so that an inner circumference of the cover portion 311 is spaced a predetermined distance from the outer circumference of the outer circumferential wall 29. In addition, the cover portion 311 is preferably formed so as to become lower from the outside up to the inside, in a case of being a three-dimensional shape as shown in FIG. 1. This is because the viewing angle for observing the ball 11 is kept wide.

The ball 11 gradually increases in speed from an accelerating force applied by air discharged from first discharge openings 35 and second discharge openings 36 (described later), and rotationally moves along the outer circumferential wall 29. On the other hand, when the discharge of air from the second discharge openings 36 is stopped, the revolution speed of the ball 11 decreases, and thus the ball 11 loses centrifugal force, rolls and falls on the inclined face 28, goes to the inside of the roulette wheel 12, and reaches the wheel 22 that is rotating. Then, the ball 11 having rolled into the wheel 22, passes over the marks 24 of the wheel 22, which is rotating, and falls into any one of the pockets 23, and the number depicted on the mark 24 corresponding to the pocket 23 in which the ball 11 falls becomes a winning number.

On the other hand, the depth L1 of the pocket 23 with respect to the inclined face 28 is arranged so as to be shallower than the diameter D of the ball 11. FIG. 8 is a schematic diagram showing a pocket. As described above, the pocket 23 is a space that is divided into 38 parts in a circumferential direction by the partitioning walls 23A and holds the ball 11. Then, since it is configured so that the depth L1 of the pockets 23 is shallower than the diameter D of the ball 11, when the ball 11 falls in the pocket 23, it is unlikely that the ball 11 will become buried in the pocket 23, and thus it is possible for the player to easily recognize the location at which the ball 11 fell in the pocket 23 in a game, as shown in FIG. 8. Accordingly, game playability is improved.

In addition, the roulette device 2 can repeatedly roll the ball 11 without having to recover it from the roulette wheel 12 by discharging compressed air on the ball 11. Therefore, a complex mechanism such as a launching unit or a movable unit for recovering the ball 11 is not necessary. In addition, the depth L1 of the pockets 23 can be made shorter than the diameter of the ball 11 (see FIG. 8). This can lower the height h3 of the roulette wheel 12 as shown in FIG. 6. Therefore, it is possible to widen a viewing angle β of the roulette device 2 for recognizing the ball 11, and facilitate the player's recognition thereof, whereby game playability is improved.

Furthermore, since the pockets 23 and the outer circumferential wall 29 are formed continuously as the single inclined face 28 that is inclined upward from the pockets 23 to the outer circumferential wall 29 at a predetermined inclined angle, the player can easily recognize the ball 11 held in the pocket 23.

Next, a first discharge opening 35 and a second discharge opening 36, which are disposed at the roulette wheel 12, are described with reference to FIGS. 6 and 7. Here, the roulette device 2 uses the air pressure of compressed air as a power source when pushing the ball 11 on the roulette wheel 12. More specifically, the compressor 14 (see FIG. 3) provided below the roulette device 2 takes in ambient air and compresses it to a predetermined pressure (e.g., 1 Mpa), and delivers the compressed air to the roulette wheel 12 via air tubes 15 and 16. Then, a force from the air pressure, discharged from the first discharge openings 35 and the second discharge openings 36, is applied to the ball 11 inside the roulette wheel 12.

As shown in FIG. 7, the first discharge openings 35 are formed to correspond to each pocket 23 in an inner side wall 37 that, along with the partitioning wall, forms the pockets 23. For example, 37 pockets 23 that respectively correspond to each number "0", "1" to "36" are formed, and thus the first discharge openings 35 are formed at 37 locations. In addition, the first discharge openings 35 are formed to be directed from the center of the roulette wheel 12 in the circumferential direction, and the air discharged from the first discharge openings 35 is emitted toward the outer circumferential wall 29 provided at the outer circumferential edge portion of the roulette wheel 12.

On the other hand, a toric arranged air pipe for launching 38 is disposed on a back side face of the inner side wall 37 on which the first discharge openings 35 are formed. The air pipe for launching 38 is connected with the air tube 15, and the first discharge openings 35 are formed at 37 locations on the outer circumference. Therefore, the air delivered from the air tube 15 momentarily flows into the air tube for launching 38, and is then discharged simultaneously to the pockets 23 from the first discharge openings 35 disposed at 37 locations. Then, according to the air pressure of the air thus discharged, the ball 11 held in any one of the pockets 23 starts to roll toward the outer circumferential wall 29 against the inclination of the inclined face 28.

Furthermore, the second discharge openings 36 are formed at predetermined intervals (e.g., 45° intervals) on the outer circumferential wall 29 (see FIG. 4). In addition, the second discharge openings 36 are formed to be oriented in a circumferential direction of the outer circumferential wall 29, i.e. a tangential direction of the roulette wheel 12, and the air discharged from each of the second discharge openings 36 produces a layer of air which flows in a clockwise direction along the outer circumferential wall 29 of the roulette wheel 12.

On the other hand, a toric arranged air pipe for revolution 39 is disposed on the back side face of the outer circumferential wall 29 on which the second discharge openings 36 are formed. The air pipe for revolution 39 is connected with the air tube 16, and the air delivered from the air tube 16 flows in the air pipe for revolution 39 and is discharged simultaneously from the second discharge openings 36 provided at 8 locations. Thus, the ball 11 that rolls to the side of the outer circumferential wall 29 due to the air discharged from the first discharge openings 35 starts to roll in a clockwise direction by the layer of the air flowing circularly along the outer circumferential wall 29.

In addition, if the discharge of air from the second discharge openings 36 is stopped, the layer of air formed along the outer circumferential wall 29 dissipates, and the revolution speed of the ball 11 decreases gradually and loses centrifugal force. Thereafter, the ball 11 rolls and falls along the inclination of the inclined face 28 toward the inside of the roulette wheel 12, and reaches the wheel 22, which is rotating. Then, the ball 11 falls into any one of the pockets 23 formed on the wheel 22. According to this, a winning number is determined by the roulette device 2, and the roulette game machine 1 pays out medals based on the number thus determined and the bet information related to the player's bet, and then ends the game.

Furthermore, upon subsequently discharging air from the first discharge openings 35, the ball 11 held in the pocket 23 starts to roll again, and thus it is possible to perform subsequent games continuously.

According to the above, it is possible to cause the ball 11 to roll and then fall into a pocket 23 repeatedly without recovering the ball 11 from the roulette wheel 12, by applying a force to the ball 11 by the air pressure of the air discharged from the first discharge openings 35 and the second discharge openings 36. Accordingly, a complex mechanism such as a launching unit or a movable unit for recovering the ball 11 is not necessary, and it is possible to facilitate maintenance and reduce costs.

In addition, the support rack 13 is a rack having a substantially rectangular shape that is formed by combining a plurality of columns made of metal, and fixes the roulette wheel 12 at a predetermined height by way of fixtures 41, which are provided at a total of 4 locations at the corners of the upper face.

Furthermore, the compressor 14 is disposed in an internal space formed in the support rack 13. The compressor 14 is a device that takes in ambient air and compresses it to a predetermined pressure (e.g., 1 Mpa). In addition, the compressor 14 includes two discharge nozzles 42 that discharge compressed air, and the air tubes 15 and 16 are connected to each of the discharge nozzles 42, respectively. As describe above, the air tubes 15 and 16 are tubes for delivering the air compressed by the compressor 14 to the first discharge openings 35 and the second discharge openings 36; a first open-close valve 17 and a second open-close valve 18 are provided at middle points therein. The first open-close valve 17 and the second open-close valve 18 are electromagnetic valves, and are of a configuration that can adjust a time period for which the valves open. Then, the first open-close valve 17 and the second open-close valve 18 are connected to a main control CPU 80 (see FIG. 10) and the main control CPU 80 controls an open-close time according to a program stored in the ROM 81 in advance (described later). Thus, the CPU 80 performs a series of operations to adjust the air pressure discharged from the first discharge openings 35 and the second discharge openings 36, causing the ball 11 to roll on the roulette wheel 12, and causing the ball to fall into a pocket 23 after a predetermined lapse of time.

FIG. 9 is a plan view showing a configuration of a lower portion of the wheel 22 and an arrangement of various sensors. As shown in FIG. 9, a sequential convex and concave portion 500 is formed at an inner circumference of the wheel 22, and more specifically, a convex portion 500*a*, which is larger than the other convex portions 500*b*, is formed at a position corresponding to "0". In addition, an origin sensor 510 is provided facing the convex and concave portion 500, and pocket position sensors 520*a* and 520*b* are provided on both side portions of the origin sensor 510. In the present embodiment, the position "0" is defined as the origin, and the convex portion 500*a* is formed at the position "0". It is possible to monitor the position of the origin by detecting passing of convex portion 500*a* by the origin sensor 510. In addition, the pocket position sensors 520*a* and 520*b* detect convex portions in the convex and concave portion 500, and it is possible to monitor the rotational position of the roulette wheel 12 based on the number of detections of the convex portions by the pocket position sensors 520*a* and 520*b* after the origin sensor 510 detects the origin.

Furthermore, two transmission sensors 530 and 550 are provided so as to be in symmetrical positions to each other with respect to the center of the wheel 22, and two reflective sensors 540 and 560 are provided at 90° positions with respect to the two transmission sensors 530 and 550. That is, the transmission sensor 530, the reflective sensor 540, the transmission sensor 550, and the reflective sensor 560 are arranged at 90° positions to each other in this order in a clockwise direction.

The reflective sensors 540 and 560 include a light emitting element and a light receiving element, and the light emitting element faces in an emission direction with respect to the center of the wheel 22. Then, when the ball 11 held in a pocket 23 passes through the position facing the light emitting element, the ball 11 reflects light from the light emitting element, and thus passing of the ball 11 is detected by the light receiving element receiving the light reflected at this time.

The transmission sensors 530 and 550 include the light emitting elements 530*a* and 550*a*, and the light receiving elements 530*b* and 550*b*, in which the light emitting elements 530*a* and 550*a* are disposed at an outer circumferential portion of the frame body 21, and the light receiving elements 530*b* and 550*b* are disposed below the wheel 22. In addition, the light emitting element 530*a* and the light receiving element 530*b*, and the light emitting element 550*a* and the light receiving element 550*b* are respectively disposed on an identical line in an emission direction with respect to the center of the wheel 22. Then, passing of the ball 11 is detected by the light receiving element detecting that the ball 11 interrupted the light from the light emitting element when the ball 11 held in a pocket 23 passes through the position facing the light emitting device.

Furthermore, by specifying the rotational position of the roulette wheel 12 at the time when the transmission sensor 530, the reflective sensor 540, the transmission sensor 550, and the reflective sensor 560 detect the ball, respectively, it is possible to determine which one of the pockets 23 corresponds to any one of the marks 24 the ball 11 falls in. It should be noted that regions on optical paths of at least the transmission sensors 530 and 500 and the reflective sensors 540 and 560 in the wheel 22 are formed by a light transmission member so that the light emitting elements 530*a* and 550*a* can reach the light receiving elements 530*b* and 550*b*, in addition to the light reflected from the ball 11 being able to reach the reflective sensors 540 and 560.

To describe in detail the method of determining the pocket 23 in which the ball 11 fell, there are two types of detection patterns for the ball 11, with one being from the transmission sensor to the reflective sensor and the other being from the reflective sensor to the transmission sensor. In the present invention, a mark that corresponds to the ball 11 is fixed when passing through the two reflective sensors. That is, in a case in which the transmission sensor detects the ball 11 first, the mark is fixed when the reflective sensor, the transmission sensor, and the reflective sensor detect the ball 11 subsequently. In a case in which the reflective sensor detects the ball 11 subsequently, the mark is fixed when the transmission sensor and the reflective sensor detect the ball 11. Therefore, the mark is fixed after the ball 11 falls in the pocket 23 and before the wheel 22 revolves one time. In addition, in a case in which there arises an irregular reaction from the transmission sensors 530 and 550 and the reflective sensors 540 and 560, for example, in a case in which detection signals are outputted in the order of transmission sensor and then transmission sensor, in a case in which a detection timing in the order of a reflective sensor, a transmission sensor, and then a reflective sensor is not clearly consistent, and in a case in which the reflective sensor detects the ball 11 immediately after the launching of the ball 11, it is configured not to fix the mark corresponding to any one of the pockets 23 in which the ball 11 fell. As causes of such errors, for example, several cases can be considered in which another ball is thrown and the number of the balls becomes multiple, the ball falls once in a pocket 23 and then moves to another pocket 23, the ball falls in a pocket 23 by air being discharged in a wrong direction due to a foreign material being stuck in the discharge opening of the air, and the like. In a case in which an irregular reaction of the transmission sensors 530 and 550 and the reflective sensors 540 and 560 arises in each rotation and continues for more than two rotations, for example, error processing such as removing the ball when multiple balls exist, is performed according to the phenomenon causing the error.

In addition, ball revolution sensors 570 and 580, which detect the ball 11 revolving inside the frame body 21, are provided at the outer circumferential portion of the frame body 21. The ball revolution sensors 570 and 580 are reflective sensors that are disposed at symmetrical positions with respect to the center of the wheel 22. Then, it is possible to monitor the revolution speed of the ball 11 revolving inside the frame body 21 by measuring the time from when the ball revolution sensor 570 detects the ball 11 up to when the ball revolution sensor 580 detects it.

Next, configurations of a control unit 6 and an image display device 7 are explained. The control unit 6 is provided at a side of the image display unit 7 shown in FIG. 1, and includes buttons operated by a player. More specifically, a bet selection button 45, a payout (cash-out) button 46, and a help button 47 are provided in order, starting from the left as viewed from a position facing the satellite 4.

The bet selection button 45 is a button provided for a player to press so as to confirm betting through the image display unit 7 (described later) after a bet operation is completed. Then, betting is confirmed, and in a case in which a bet is placed on the mark 24 that corresponds to the pocket 23 in which the ball 11 fell in at the roulette device 2 in a game, the player wins an award. When the player wins an award, credits corresponding to the number of chips bet are added to the current credits of the player.

The payout button 46 is a button which is usually pressed at the end of a game. When the payout button 46 is pressed, medals corresponding to the current credits (normally, 1 medal for 1 credit) that the player has acquired through the game are paid out from the payout opening 8.

The help button 47 is a button that is pressed in a case where a method of operating the game is unclear, and upon the help button being pressed, a help screen showing various kinds of operation information is displayed immediately thereafter on the image display unit 7.

On the other hand, the image display unit 7 is a so-called touch-panel type of liquid crystal display, on the front surface of which a touch panel 48 is attached, allowing a player to perform selections by pressing, e.g., with a finger, icons displayed on a liquid crystal screen.

Figure 10:
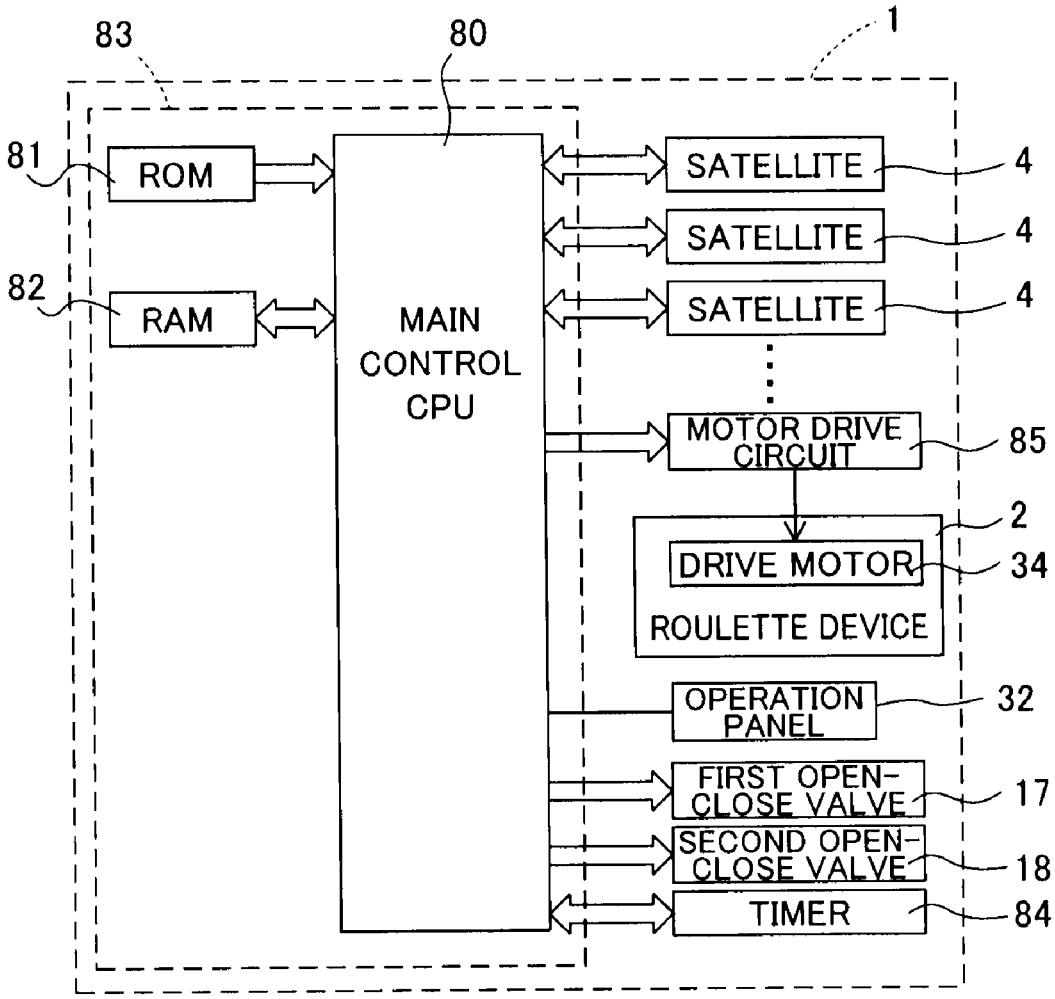
FIG. 10 is a block diagram schematically showing a control system of the roulette game machine according to the embodiment of the present invention.

Next, a configuration relating to the control system of the roulette game machine 1 is explained with reference to FIG. 10. FIG. 10 is a block diagram schematically showing the control system of the roulette game machine 1. As shown in FIG. 10, the roulette game machine 1 is configured with a main control unit 83 including a main control CPU 80, ROM 81, and RAM 82, a roulette device 2 connected with the main control unit 83, and 10 satellites 4 (see FIG. 2), a first open-close valve 17 and a second open-close valve 18, and an operation panel 32.

The main control CPU 80 carries out various processing based on input signals supplied from the respective satellites 4 as well as on data and programs stored in the ROM 81 and the RAM 82, and transmits a command signal to the satellites 4 based on the result of the above described processing so as to mainly control the respective satellites 4, thereby advancing the game. Furthermore, based on detection signals from an origin sensor 510, pocket position sensors 520*a* and 520*b*, a transmission sensor 530, a reflective sensor 540, a transmission sensor 550, and a reflective sensor 560, the determination of a winning number of the pocket 23 in which the ball 11 fell is performed. The determination is performed for each bet chip based on the winning number thus obtained, and the bet information transmitted from each of the satellites 4. Furthermore, the credit amount which is to be paid out at each of the satellites is calculated.

The ROM 81 is, for example, configured with semiconductor memory and the like, and stores a program for realizing basic functions of the roulette game machine 1, a program for controlling respective devices in the roulette device 2, the first open-close valve 17, and the second open-close valve 18, odds for a normal roulette game using the bet screen (the amount of credits paid out per one chip for winning), a program for mainly controlling each of the satellites 4, and the like.

On the other hand, the RAM 82 temporarily stores bet information with respect to the chips supplied from the respective satellites 4, a winning number of the roulette device 2, data relating to the results of the processing executed by the main control CPU 80, and the like.

In addition, the first open-close valve 17 and the second open-close valve 18 that perform adjustment of the air pressure within the air tubes 15 and 16 are connected to the main control CPU 80. Then, by opening the first open-close valve 17, air that has been compressed by way of the compressor 14 (see FIG. 3) is discharged from the first discharge openings 35 that are provided at the pockets 23. In addition, by opening the second open-close valve 18, air that has been compressed by way of the compressor 14 is discharged from the second discharge openings 36 that are provided at the outer circumferential wall 29.

Then, the first open-close valve 17 is opened for a predetermined time (e.g., 2 seconds), a predetermined time after bet acceptance has begun. As a result, the ball 11, which had been held in the pocket 23 since the end of the previous game, is caused to roll in a direction toward the outer circumferential wall 29.

Subsequently, the second open-close valve 18 is opened and a layer of air flowing along the outer circumferential wall 29 of the roulette wheel 12 is generated. Then, the ball 11 that has rolled into outer circumferential wall 29 by way of air pressure from the first discharge openings 35 rolls in a clockwise direction according to the layer of the air flowing circularly along the outer circumferential wall 29.

Thereafter, upon a predetermined time lapsing, when the second open-close valve 18 is closed, the air flow discharged from the second discharge openings 36 also stops, and the revolution speed of the ball 11 gradually slows down. Then, a bet is ended immediately before the ball loses its centrifugal force, and falls and rolls down the inclined face 28, and then the ball falls in any one of the pockets 23.

Bet end timing is set through an external operation of the operation panel 32 by staff in a game hall. For example, settings are performed such as ending a bet when the number of remaining revolutions is one, and furthermore, switching BGM five revolutions before it is performed so as to notify players that the bet end timing is near.

Then, the main control CPU 80 performs determination of the winning number based on the origin sensor 510, the pocket position sensors 520*a* and 520*b*, the transmission sensor 530, the reflective sensor 540, the transmission sensor 550, and the reflective sensor 560.

In addition, a drive motor 34 that drives the wheel 22 of the roulette wheel 12 to revolve is connected to the main control CPU 80 via a motor drive circuit 85. Then, over a period from immediately after the ball 11 begins to roll until a predetermined time period elapses after the ball 11 has fallen into a pocket 23, the drive motor 34 is controlled so that the wheel 22 is caused to rotate in a predetermined direction with respect to the frame body 21 (e.g., in a clockwise direction) and at a predetermined speed.

Furthermore, a timer 84 for performing time measurement is connected to the main control CPU 80. Time information of the timer 84 is transmitted to the main control CPU 80, and the main control CPU 80 performs opening and closing of the first open-close valve 17 and the second open-close valve 18 based on the time information of the time 84 as described later.

Figure 11:
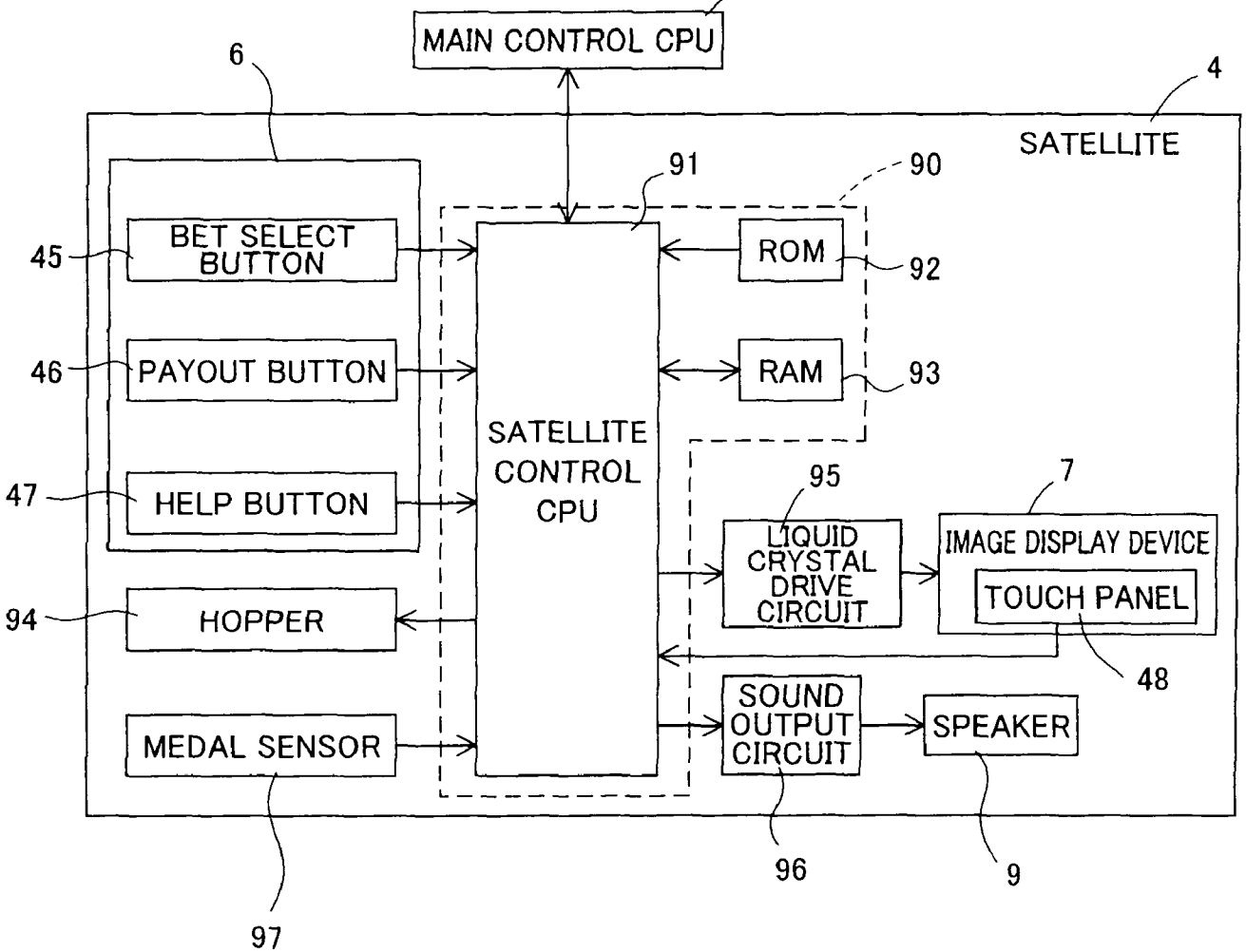
FIG. 11 is a block diagram schematically showing a control system of a satellite according to the embodiment of the present invention.

Next, a configuration related to a control system of the satellite 4 connected to the main control CPU 80 in the main control unit 83 is explained with reference to FIG. 11. FIG. 11 is a block diagram schematically showing a control system of a satellite. It should be noted that a configuration in which ten satellites 4 are provided has the same configuration as that in which one satellite 4 is provided. Therefore, a configuration in which one satellite 4 is provided is explained as an example below.

As shown in FIG. 11, the satellite 4 is configured with a satellite control unit 90 and several peripheral devices. The satellite control unit 90 includes a satellite control CPU 91, ROM 92, and RAM 93. The ROM 92, which is configured with semiconductor memory or the like, for example, stores a program for implementing basic functions of the satellite 4, various other programs needed to control the satellite 4, a data table, and the like. In addition, the RAM 93 is memory for temporarily storing various types of data computed by the satellite control CPU 91, an amount of credits that a player currently possesses, a bet status of chips by the player, and the like.

Furthermore, a bet select button 45, a payout button 46, and a help button 47 provided in the control unit 6 (see FIG. 2) are connected to the satellite control CPU 91, respectively. Then, the satellite control CPU 91 controls various corresponding operations that should be executed, based on manipulation signals, which are outputted in response to each button pressed by a player. More specifically, the satellite control CPU 91 executes various processing, based on input signals supplied from the control unit 6 in response to a player's manipulation which has been inputted, as well as on the data and programs stored in the ROM 92 and the RAM 93. Subsequently, the satellite control CPU 91 transmits the results to the main control CPU 80 in the main control unit 83.

On the other hand, the satellite control CPU 91 receives a command signal from the main control CPU 80, controls the peripheral devices, which are components of the satellite 4, and advances a roulette game at the satellite 4. In addition, the satellite control CPU 91 carries out various processing, depending on the contents of the processing, based on an input signal supplied from the control unit 6 in response to the operational input of a player as well as based on data and programs stored in the ROM 92 and the RAM 93, controls the peripheral devices, which are components of the satellite 4, based on the results of the above described processing, and advances a roulette game at the satellite 4. It should be noted that the mode in which processing is performed is set for each type of processing depending on the content of the processing. For example, processing for payout of medals according to a winning number falls into the former and processing for a bet operation on the bet screen 131 by a player falls into the latter.

In addition, a hopper 94 is connected to the satellite control CPU 91. The hopper 94 pays out a predetermined number of medals from a medal payout opening 8 (see FIG. 2) according to an instructional signal from the satellite control CPU 91.

Furthermore, an image display device 7 is connected to the satellite control CPU 91 via a liquid crystal drive circuit 95. The liquid crystal drive circuit 95 includes program ROM, image ROM, an image control CPU, work RAM, a video display processor (VDP), video RAM, and the like. Then, the program ROM stores an image control program related to the display functions of the image display device 7, and various kinds of selection tables. Furthermore, the image ROM stores dot data for creating an image to be displayed by the image display device 7, for example. In addition, the image control CPU determines an image to be displayed on the image display device 7, selected from the dot data previously stored in the image ROM according to the image control program previously stored in the program ROM based on parameters set by the satellite control CPU 91. The work RAM is configured as a temporary storage means when executing the image control program by the image control CPU. The VDP forms an image corresponding to display contents determined by the image control CPU, and outputs the resulting image to the image display device 7. It should be noted that the video RAM is configured as a temporary storage means when an image is formed by the VDP.

In addition, the touch panel 48 as described above is attached to the front side of the image display device 7, and the information related to an operation on the touch panel 48 is transmitted to the satellite control CPU 91. With the touch panel 48, a bet operation for placing a chip by a player is performed on the bet screen displayed. More specifically, an operation of a selection of a bet area and the like are performed by operating the touch panel 48, and the information related thereto is transmitted to the satellite control CPU 91. Then, the RAM 93 stores the current player bet information (the bet area designated on the bet screen, and the amount of chips bet) based on this information. Furthermore, the bet information is transmitted to the main control CPU 80 and stored in a bet information storage area of the RAM 82.

A sound output circuit 96 and a speaker 9 are connected to the satellite control CPU 91, and the speaker 9 produces various sound effects when performing various renderings based on output signals from the sound output circuit 96.

In addition, a medal sensor 97 is connected to the satellite control CPU 91. The medal sensor 97 detects the medals inserted from the medal insertion opening 5 (see FIG. 2), counts the medals thus inserted, and transmits the results to the satellite control CPU 91. Then, the satellite control CPU 91 increments the credit amount of the player, which has been stored in the RAM 93, based on the signal thus transmitted.

Main processing of the roulette device 2 is explained with reference to FIG. 12.

In Step S10, the main control CPU 80 performs initial setting processing such as RAM access permissions, backup return processing, and initialization of working area. When this processing is terminated, the processing advances to Step S20.

In Step S20, the main control CPU 80 performs game start processing. When this processing is terminated, the processing advances to Step S30.

In Step S30, the main control CPU 80 performs input monitoring processing. In this processing, the main control CPU 80 performs processing for monitoring of detection signals from the origin sensor 510, pocket position sensors 520*a* and 520*b*, transmission sensors 530 and 550, reflective sensors 540 and 560, and ball revolution sensors 570 and 580. When this processing is terminated, the processing advances to Step S40.

In Step S40, the main control CPU 80 performs drive motor control processing. In this processing, the main control CPU 80 performs rotation control of the drive motor so as to change the rotation speed of the wheel 22 randomly in each game. When this processing is terminated, the processing advances to Step S50.

In Step S50, the main control CPU 80 performs compressor control processing. In this processing, the main control CPU 80 performs drive control of the compressor 14 so as to change the time period of lateral air blowing toward the ball 11 randomly in each game. More specifically, drive control of the compressor 14 is performed based on the time period of lateral air blowing. When this processing is terminated, the processing advances to Step S60.

In Step S60, the main control CPU 80 performs BGM control processing. When this processing is terminated, the processing advances to Step S70.

In Step S70, the main control CPU 80 performs lamp control processing that performs lighting control of various types of lamps. When this processing is terminated, the processing advances to Step S80.

In Step S80, the main control CPU 80 performs game result determination processing. In this processing, the main control CPU 80 determines a pocket in which the ball 11 has fallen based on detection signals from the origin sensor 510, pocket position sensors 520*a* and 520*b*, transmission sensors 530 and 500, and reflective sensors 540 and 560. More specifically, during rotation of the wheel 22 after the ball 11 has fallen into a pocket, when either one of the reflective sensors 540 and 560 detects the ball 11, by specifying a rotating position of the wheel from the origin at that point in time based on the detection signals of the origin sensor 510 and the pocket position sensors 520*a* and 520*b*, the type of the pocket located at the reflective sensors 540 and 560 that detected the ball 11 is specified. In this way, it is possible to specify the type of pocket in which the ball 11 falls. Then, a game result is compared with bet information received from the satellite 4, and the number of medals to be paid out at each satellite 4 is determined. Thereafter, by setting in the RAM 82 the game result, namely data of a mark 24 that corresponds to the pocket in which the ball 11 fell and the number of medals thus paid out, mark data that corresponds to a pocket and the like is transmitted to the satellite in accordance with the processing of Step S90. When this processing is terminated, the processing advances to Step S90.

In Step S90, the main control CPU 80 performs processing to transmit and receive various types of data with the satellite 4. More specifically, game start data, remaining revolution data, game result data, data of the number of medals paid out, and the like are transmitted from the main control CPU 80 to the satellite 4, and data related to bet information is transmitted from the satellite 4 to the main control CPU 80. When this processing is terminated, the processing advances to Step S100.

In Step S100, game end processing is performed. In this processing, after transmitting the game result to the satellite 4, the main control CPU 80 performs processing to return various types of variables and flags into an initial state such as turning off a flag of remaining revolutions and a BGM flag. When this processing is terminated, the processing advances to Step S20.

Although a roulette game machine 1 according to the present invention has been explained above, according to the embodiment described above, a guide portion 291 that protrudes towards inside of the roulette wheel 12 is provided at the upper portion of the outer circumferential wall 29, and the length that the guide portion 291 protrudes is made to be shorter than the radius of the ball 11. Accordingly, the guide portion 291 does not cover the ball 11 entirely, and even if the ball 11 revolves along the outer circumferential wall 29, the ball 11 can be viewed. In addition, due to being provided at the upper portion of the outer circumferential wall 29, the ball 11 can be prevented from jumping to outside due to centrifugal force.

Furthermore, according to the embodiment described above, the cover portion 311 is provided on the upper face of the table-frame portion 31 positioned outside of the outer circumferential wall 29, and thus the inner circumferential edge of the cover portion 311 is positioned so as to be spaced a predetermined distance from the outer circumference of the outer circumferential wall 29. As a result, it is possible to make the viewing angle for the players and spectators around the roulette game machine 1 to view the ball 11 revolving on the roulette wheel 12 to be large.

The guide portion 291 in the embodiment described above has a substantially triangular cross-section; however, it is not limited thereto. For example, the cross-section may be semi-circular, and may be formed in a shape such that the lower face side of the guide portion 291 follows the curved surface of the ball 11.

Figure 12:
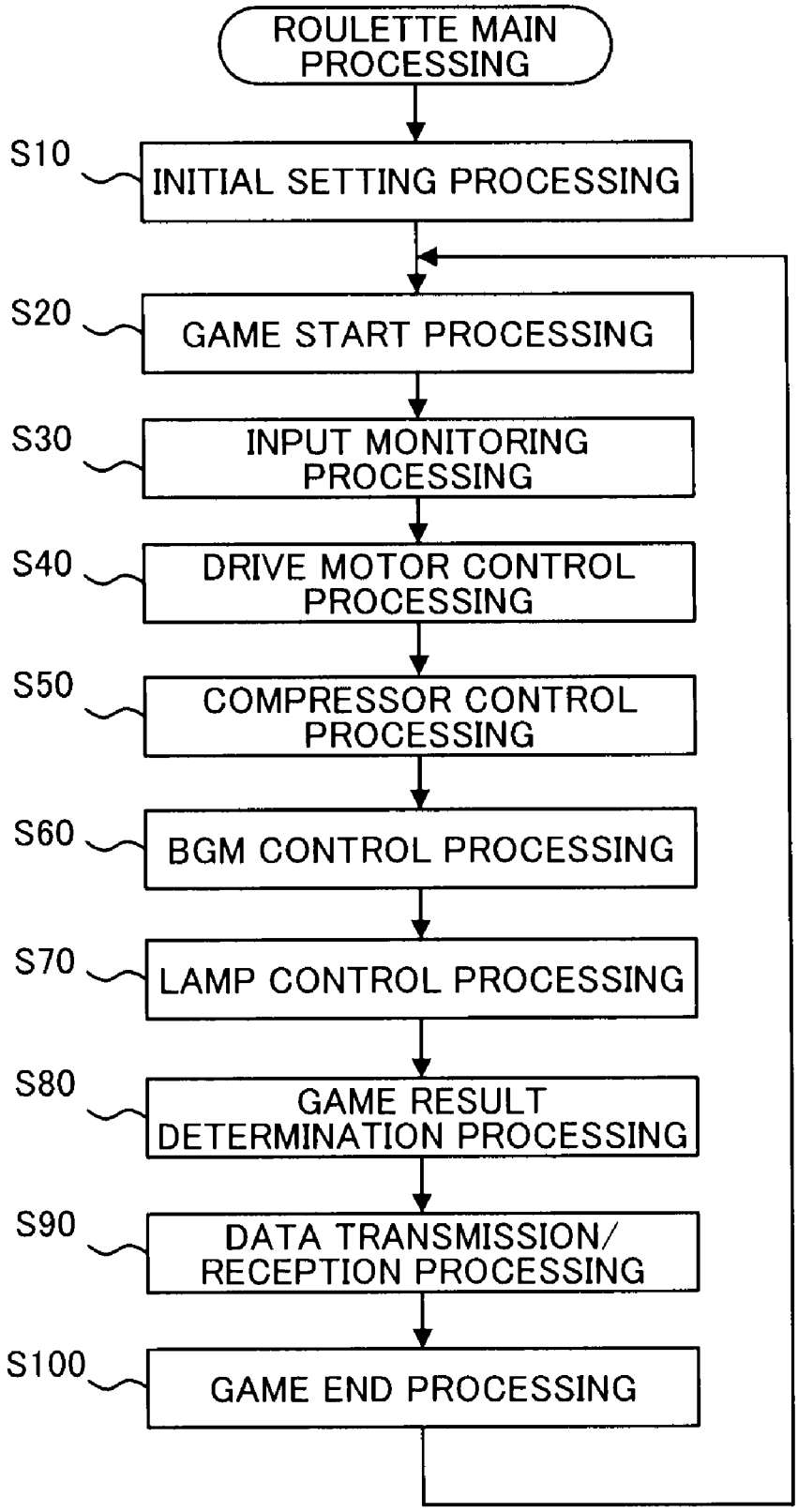
FIG. 12 is a flowchart showing main processing of a roulette device according to the embodiment of the present invention.
Figure 13:
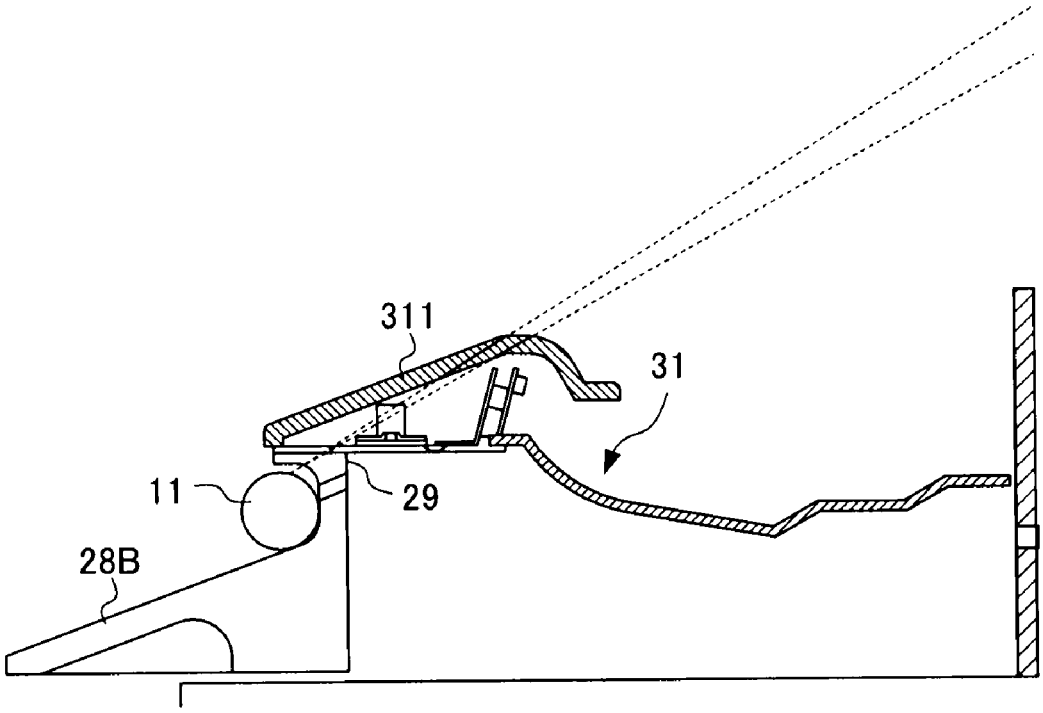
FIG. 13 is an external perspective view showing a schematic configuration of a roulette game machine according to the embodiment of the present invention.

In addition, in the embodiment described above, the length that the guide portion 291 protrudes to the inner circumferential side of the inclined face 28 is made smaller than the radius of the ball 11; however, as shown in FIG. 12, in a case where the cover portion 311, guide portion 291, and at least a portion of the table-frame portion 31 and outer circumferential wall 29 are formed with a transparent component, the length may be the radius of the ball 11 or more. By making transparent components, it becomes possible to view the ball 11 revolving along the outer circumferential wall 29.

What is claimed is:

1. A roulette game device with a roulette wheel comprising:

a roulette wheel having a plurality of pockets which is created so as to be continuous in a circumferential direction and in which a ball is held;

an inclined face formed so as to extend from the plurality of pockets to an outer circumferential direction;

a plurality of marks located on the inclined face, and created to correspond to each of the plurality of pockets; and an outer circumferential wall that is provided in an endless manner along an outer circumferential edge of the inclined face, wherein the outer circumferential wall includes a guide portion of a loop shape that is provided at an upper portion of the outer circumferential wall, and provided so as to protrude towards inside of the inclined face, wherein a length that the guide portion protrudes towards the inside is shorter than a length of a radius of the ball, and wherein the guide portion has an incline portion at an upper face side, and the incline portion inclines from an upper side of the outer circumferential wall towards a lower side of the outer circumferential wall.

2. The roulette game device according to claim 1, further comprising:

a table-frame portion that is provided outside of the outer circumferential wall; and a cover portion that is disposed on an upper face side of the table-frame portion, and is disposed so as to follow an outer circumference of the outer circumferential wall, and so as to cover at least a portion of a top surface of the table-frame portion, wherein an inner circumferential edge of the cover portion is disposed at a position that is spaced a predetermined distance from the outer circumferential wall.

3. The roulette game device according to claim 2, wherein the guide portion, the cover portion, and at least a portion of the outer circumferential wall are transparent.

4. The roulette game device according to claim 1, wherein the incline portion is formed so as to fall downward at a predetermined angle from a leading edge of the outer circumferential wall.

5. The roulette game device according to claim 4, wherein the inclined portion makes a triangular cross-section in the guide portion.

* * * * *